US005765226A

United States Patent [19]

Douady et al.

[11] Patent Number: 5,765,226

[45] Date of Patent: Jun. 16, 1998

[54] MASSAGING GARMENT

[76] Inventors: Dominique Douady, Via Morgagni 19, 00198 Rome, Italy; Marie-France Jacqueline Henriette Jaunet, 5 rue du Colonel Oudot, 75012 Paris, France

[21] Appl. No.: 704,790

[22] PCT Filed: Mar. 14, 1995

[86] PCT No.: PCT/FR95/00303

§ 371 Date: Sep. 5, 1996

§ 102(e) Date: Sep. 5, 1996

[87] PCT Pub. No.: WO95/24881

PCT Pub. Date: Sep. 21, 1995

[30] Foreign Application Priority Data

Mar. 14, 1994 [FR] France ..... 94 02935

[51] Int. Cl.[6] ..... A41B 1/00

[52] U.S. Cl. ..... 2/69; 2/115

[58] Field of Search ..... 2/69, 79, 102, 2/108, 227, 228, 238, 106, 114, 115, 239, 409, 158, 159, 161.1, 161.7, 455, 456, 458, 410, 411, 413, DIG. 10, DIG. 3; 36/43, 71, 153, 93, 28, 141; 128/DIG. 20; 601/76, 84, 85, 88, 148, 149, 151; 602/2, 13; 606/201, 204; 607/80

[56] References Cited

U.S. PATENT DOCUMENTS

| | | | |
|---|---|---|---|
| 1,111,222 | 9/1914 | Forrester | 2/455 |
| 3,995,320 | 12/1976 | Zafuto | 2/DIG. 3 X |
| 4,214,588 | 7/1980 | Byler . | |
| 5,007,111 | 4/1991 | Adams | 2/455 |
| 5,157,789 | 10/1992 | Klass | 2/69 |
| 5,274,846 | 1/1994 | Kolsky | 2/455 |
| 5,329,640 | 7/1994 | Hourigan | 2/DIG. 3 X |
| 5,347,656 | 9/1994 | Fabritz et al. | 2/DIG. 3 X |
| 5,383,843 | 1/1995 | Watson et al. | 2/DIG. 3 X |
| 5,435,009 | 7/1995 | Schild et al. | 2/DIG. 3 X |
| 5,596,770 | 1/1997 | Kunesh | 2/DIG. 3 X |

FOREIGN PATENT DOCUMENTS

| | | |
|---|---|---|
| 202645 | 12/1906 | Germany . |
| 515715 | 11/1971 | Switzerland . |
| WO 88/10074 | 12/1988 | WIPO . |

*Primary Examiner*—Gloria M. Hale
*Attorney, Agent, or Firm*—Young & Thompson

[57] ABSTRACT

A garment for massaging muscle masses of a person's body. The garment includes plural flexible channels that are separate and independent, sealed, and elongated, and that are each partially filled with a substantially incompressible free by flowable material and oriented substantially in a direction of fibers of the muscle masses to be massaged. Muscle masses are massaged by movement of the flowable material in the channels caused by movement of the muscle masses to be massaged. A flexible cover maintains the channels in contact with the muscles to be massaged. Plural garment portions may be provided, each corresponding to a particular muscle mass of the person's body that is to be massaged and that has a generally uniform alignment of muscle fibers.

16 Claims, 1 Drawing Sheet

MASSAGING GARMENT

BACKGROUND OF THE INVENTION

The invention relates to a garment for massaging at least one part of a person's body.

DESCRIPTION OF THE PRIOR ART

Document FR-A-2 144 971 describes an inflatable garment of this type. Said garment comprises contiguous pockets of impervious fabric which can each be inflated and deflated by way of a connection tube linked to a suitable source of compressed air, and using a programmed apparatus with which it is possible to selectively control the inflation and deflation of said pockets in accordance with a predetermined sequence.

With said garment it is possible to exert on the body of the user, or on a part of said body, a massaging action analogous to that which is performed manually by a physiotherapist.

However, said garment has the disadvantage of requiring a source of compressed air and a control apparatus for effecting the inflation and deflation of the pockets and, consequently, the required massage. It is thus intended to be used at a site provided with such equipment and does not allow the person using it to move about freely.

It is also known, from documents U.S. Pat. Nos. 4,100,686 and 4,567,677, to massage the feet, while walking, by means of soles which are partially filled with an incompressible fluid such as water or a gel. These soles consist of two flexible and impermeable sheets, for example made of a plastic material, which are sealed and form a pocket partially filled by the fluid. During walking, the displacement of the fluid in the pocket along the length of the sole massages the plantar surface of the feet. According to said document U.S. Pat. No. 4,567,677, weld seams provided between the two sheets in the area of the plantar arch define loss-of-head zones for limiting the movement of the fluid between the front and rear parts of the sole.

Such soles permit an effective massage of the plantar surface of the feet. However, on account of their configuration, they are not suitable for massaging other parts of the human body.

The object of the invention is to provide a garment of simple design which, without recourse to any external equipment, and while leaving its user completely free to move about and maneuver, allows the part of the body covered by the garment to be massaged automatically when said part of the body moves.

SUMMARY OF THE INVENTION

To this end, the subject of the invention is a garment for massaging at least one part of a person's body, comprising a flexible cover designed to hug at least said part of the body and equipped with means for confinement of a fluid which is capable of being made to move about in order to massage said part of the body, wherein said confinement means consist of separate sealed channels which are each partially filled with an incompressible fluid and each oriented substantially in the direction of the fibers or muscle masses with which they are in contact when said cover is in place on said part of the body.

Said cover and the walls of said channels are preferably made of stretchable material, and said cover consists of several portions joined together and each designed to correspond substantially to the contour of a muscle mass of said part of the body.

Thus, as a result of the displacement of the fluid inside the channels, wearing the garment according to the invention automatically ensures a suitable massage in the desired direction, namely in the longitudinal direction of the muscle fibers.

BRIEF DESCRIPTION OF THE DRAWINGS

Other characteristics and advantages of the invention will be evident from the following description of an embodiment which is given solely by way of example and which is illustrated by the attached drawings, in which.

DESCRIPTION OF THE PREFERRED EMBODIMENT

Figure 1:
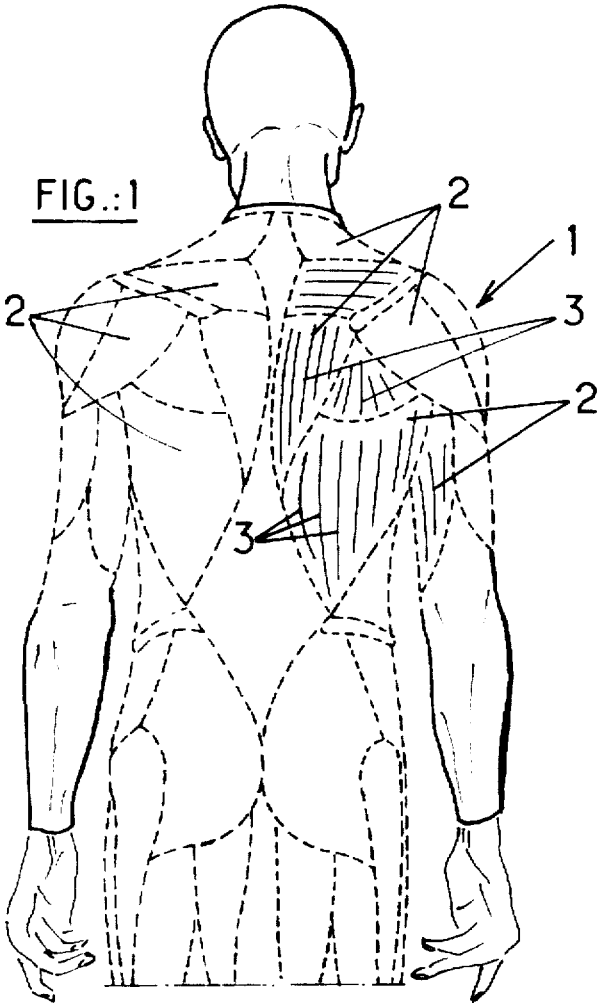
FIG. 1 is a partial elevation view, from behind, of a person wearing a garment according to the invention.

Referring to FIG. 1, a garment according to the invention consists of a number of portions 2 which are cut in such a way that once the garment is being worn by a person as depicted in the figure, the outline of each portion corresponds substantially to that of a muscle zone or mass of said person. In the drawing, the outline of the portions 2 is symbolized by broken lines, which thus correspond substantially to the limit between two contiguous muscle zones or between a muscle zone and a zone comprising tendons or bone.

Along its surface, each portion 2 of the garment 1 includes one or more channels 3 which are separate from each other and which are each partially filled with an incompressible fluid, for example a liquid such as water. The channel or channels 3 of each portion 2 of the garment are each oriented in the direction of the fibers of the muscle masses or zones with which they are in contact when the garment is being worn.

Figure 2:
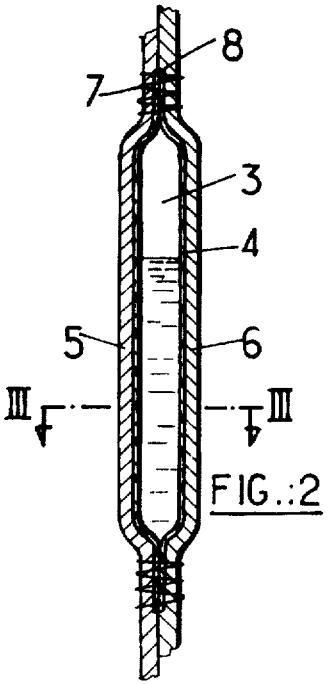
FIG. 2 is a cross section, on an enlarged scale, along the length of a channel of the garment in FIG. 1.
Figure 3:
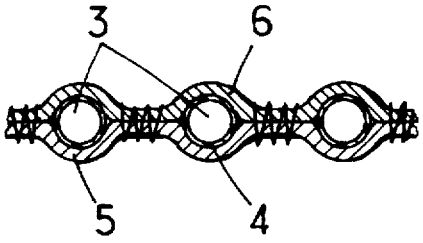
FIG. 3 is a cross section on the plane III—III in FIG. 2.

As is also depicted in FIGS. 2 and 3, each channel 3 is defined by an elongate tubular sheath 4 made of a material which is impervious to the fluid and which can be stretched at least in its longitudinal direction. The sheath 4 is made, for example, of an elastomeric material or a stretchable fabric which is impervious or has been rendered impervious by a conventional treatment. The sheath 4 is preferably made of a material or fabric which can be stretched in one direction.

Each sheath 4 is sandwiched between an inner fabric 5 and an outer fabric 6, both of which are also stretchable, for example a LYCRA-type fabric. The fabrics 5 and 6 are preferably stretchable in one direction, the direction of stretching being oriented along the length of the sheaths 4. The fabrics 5 and 6 preferably have characteristics of elongation similar to those of the sheath 4.

Each sheath 4 is fixed in the desired position between the fabrics 5 and 6 by a seam 7 which is made in these fabrics around the sheath 4 by means of an elastic thread. If the sheath 4 is formed by the assembly of two sheets defining a peripheral margin 8, the seam 7 is preferably sewn through this margin 8.

Preferably, approximately one half to two thirds of the volume of the channels 3 is filled with the incompressible fluid, and the remainder with air. The incompressible fluid is preferably water, although it can be another liquid, sand, or other substance. The channels 3 have, for example, a length of between a few centimeters and about ten or so centimeters, and a cross section of the order of several tenths of a square centimeter.

Finally, the various portions 2 of the garment 1 are joined together around their outlines, as depicted by broken lines in FIG. 1, by seams of elastic threads. The garment as a whole is designed to hug the part of the body of the person wearing it, in the manner of a body stocking. Depending on the requirements, the garment 1 may cover only part or else the whole of the body, and in the latter case it can be made up of one or more parts which overlap at their junctions, it being possible for one of the two parts to be without channels 3 in the overlap zone.

When the garment 1 is being worn, the part of the body covered by it is continuously being massaged gently by the movement of the incompressible fluid in the channels 3 under the influence of the movements of the body and of the muscle masses. This massage is particularly effective because of the fact that it is being carried out continuously in an optimum manner and without effort at each point of the body covered by the garment, thereby affording a feeling of well-being.

It goes without saying that the embodiment which has been described is only an example and that it could be modified, particularly by substitution of technical equivalents, without thereby departing from the scope of the invention.

Thus, for example, the portions 2 could be joined to each other and to the sheaths 4 by means other than seams, for example by adhesive bonding.

In addition, all of the sheaths 4 forming a portion 2 can be made in one piece, for example by means of two impermeable sheets shaped and joined together by any suitable conventional means.

We claim:

1. A garment for massaging muscle masses of a person's body, comprising:

plural flexible channels that are impervious, separate and independent, sealed, and elongated, and that are each partially filled with a substantially incompressible freely flowable material and oriented substantially in a direction of fibers of the muscle masses to be massaged, wherein the muscle masses are massaged by movement of said flowable material in said channels under the influence of the movements of the body and the muscle masses to be massaged; and a flexible cover for maintaining said channels in contact with the muscles to be massaged.

2. The garment as claimed in claim 1, wherein said channels have walls, and wherein said cover and the walls of said channels are made of a stretchable material.

3. The garment as claimed in claim 2, wherein said cover comprises plural portions joined together, each of said portions corresponding substantially to a contour of a different muscle mass to be massaged.

4. The garment as claimed in claim 3, wherein said stretchable material is stretchable essentially in one direction, and wherein each of said portions is aligned so that the one direction of stretching of said stretchable material corresponds substantially to an orientation of the fibers of the muscle mass to be massaged.

5. The garment as claimed in claim 3, wherein said portions are joined together by stretchable connecting means.

6. The garment as claimed in claim 1, wherein said cover comprises at least two layers of fabric between which said channels are disposed.

7. The garment as claimed in claim 6, wherein said channels are defined by impervious sheaths assembled between said layers of fabric.

8. The garment as claimed in claim 7, wherein said sheaths are joined to said layers by stretchable connecting means.

9. The garment as claimed in claim 1, wherein approximately one half to two thirds of a volume of each of said channels is filled with said flowable material, and the remainder with a gas.

10. The garment as claimed in claim 1, wherein said flowable material comprises a liquid.

11. The garment of claim 1, wherein said flowable material comprises a granulated solid.

12. A garment for massaging muscle masses of a person's body, comprising:

plural garment portions, each of said portions corresponding to a particular muscle mass of the person's body that is to be massaged and that has a generally uniform alignment of muscle fibers;

each of said portions comprising plural elongated channels that are separate and independent, sealed, and flexible, and that are each partially filled with a substantially incompressible freely flowable material and oriented substantially in a direction of the muscle fibers of the corresponding muscle mass to be massaged, wherein the muscle masses are massaged by movement of said flowable material in said channels under the influence of the movements of the body and the muscle masses to be massaged.

13. The garment of claim 12, further comprising a cover for holding each of said portions against the corresponding muscle mass to be massaged.

14. The garment of claim 12, wherein each of said channels is one half to two -thirds filled with said flowable material.

15. The garment of claim 12, wherein said flowable material comprises a liquid.

16. The garment of claim 12, wherein said flowable material comprises a granulated solid.

* * * * *